United States Patent [19]

Whiteman, Jr.

[11] 4,312,603

[45] Jan. 26, 1982

[54] TWIN TROWEL CEMENT FINISHING MACHINE

[75] Inventor: Marvin E. Whiteman, Jr., Eagle, Id.

[73] Assignee: Whiteman Manufacturing Company, Boise, Id.

[21] Appl. No.: 159,404

[22] Filed: Jun. 13, 1980

[51] Int. Cl.[3] ..... E01C 19/22

[52] U.S. Cl. ..... 404/112; 15/49 R; 51/177

[58] Field of Search ..... 404/112; 51/177; 15/50 R, 49 R

[56] References Cited

U.S. PATENT DOCUMENTS

| | | | |
|---|---|---|---|
| 2,198,929 | 4/1940 | Whiteman | 404/112 |
| 2,277,389 | 3/1942 | Conway | 404/112 |
| 2,689,507 | 9/1954 | McCrery | 404/112 |
| 2,887,934 | 5/1959 | Whiteman | 404/112 |
| 3,412,657 | 11/1968 | Colizza et al. | 404/112 |
| 3,936,212 | 2/1976 | Holz, Sr. et al. | 404/112 |
| 3,973,857 | 8/1976 | Whiteman, Jr. | 404/112 |
| 4,046,484 | 9/1977 | Holz, Sr. et al. | 404/112 |

*Primary Examiner*—C. J. Husar

*Assistant Examiner*—R. Calderon

*Attorney, Agent, or Firm*—R. Welton Whann

[57] ABSTRACT

A power driven twin trowel cement finishing machine in which two sets of counter rotating troweling blades have intersecting circular trowling area, each set of troweling blades being carried by a rotatable shaft upon which the blades are supported and arranged for remote relative adjustments from a guiding handle of the sets of troweling blades to vary their troweling angle with respect to the associated cement surface. The two sets of troweling blade assemblies have their rotatable shafts supported for relative tilting movements in opposite directions from a normal generally vertical position to selectively oppositely inclined planes of rotation of the sets of troweling blades in a manner to generate reactive blade forces that will be operative to bodily propel the machine either in a forward or reverse direction, while permitting manual lateral controlled movements of the machine by means of the guiding handle. Remote control mounted on the guiding handle is operable to vary the orientation of the planes of rotation of the sets of troweling blades and the consequent propelled direction of movement of the machine.

18 Claims, 6 Drawing Figures

TWIN TROWEL CEMENT FINISHING MACHINE

BACKGROUND OF THE INVENTION

The present invention relates generally to the working of cement.

It has heretofore been generally known, as exemplified by U.S. Pat. No. 2,887,934, to provide cement finishing machines of the type which employs two rotors having radiating troweling blades, the blades of the two rotors being so related and operated that the reaction forces between the blades and the cement are cancelled out. In this known embodiment, a guiding handle, centrally attached to the machine frame, provides for manually and rather laboriously pulling the machine in a forward or generally forward direction during the troweling operation. The controls mounted on the handle were also provided for simultaneously varying the tilt angle of the troweling blades carried by the two rotors.

It has also been known to provide ride-on troweling machines of the type having two sets of troweling blades, in which the blade sets are relatively tiltable by means of a rider rotatable steering handle to control the direction of travel by reactive forces generated between the blades and the cement. Due to the operating characteristics of this type of machine, it is not possible to utilize a meshed arrangement of the blades of the adjacent sets of troweling blades to provide intersecting circular troweling areas. As a consequences the line of movement of the machine must be carefully maintained at an angle to the longitudinal frame axis, in order to avoid producing untroweled areas between the troweling blade sets.

The troweling machine of the present invention is a radical departure from the operative concepts, as known from the above noted Patent and ride-on machines and provides a unique arrangement for utilizing the reactive forces between the blades and the cement to generate controllable propelling forces that may be selectively utilized to self-propel the troweling machine in either a forward or reverse direction and wherein the handle is positioned at one end of the machine frame structure, and enables manual lateral movements of the machine with respect to its propelled direction of travel.

The invention also is unique in that it not only provides an arrangement in which the direction of travel may be controlled by raising and lowering movements of the handle, but also provides remote control members on the guiding handle for regulating and adjusting the reactive propelling forces, as well as for independently adjusting and simultaneously varying the tilt angle of the troweling blades of the respective rotors.

SUMMARY OF THE INVENTION

More specifically, the present invention relates to a cement finishing machine which is self-propelled by reactive forces generated between the troweling blades of the machine and the cement surface that is being finished.

It is one object of the herein described invention to provide an improved and unique cement finishing machine having two sets of troweling blade assemblies that are selectively relatively adjustable to generate reactive forces between the blades and cement for propelling the machine in either a forward or reverse path of movement.

A further object is to provide a controllable self-propelled cement finishing machine with a guiding handle that is so disposed as to enable the machine to be manually moved in directions extending transversely to its self-propelled path of movement.

A further object is to provide a cement finishing machine having two sets of troweling blade assemblies which are interlinked for interactive adjusting tilting movement by manual raising and lowering movements of an associated guiding handle, to thereby control the forward and reverse directions of movement of the machine by the reactive forces generated between the troweling blades and the cement.

Another object is to provide in a cement finishing machine having two sets of troweling blade assemblies, a guiding handle which mounts manual operable means for selectively controlling propelled movements of the machine in forward or reverse directions; as well as manually operable means for selectively adjusting the tilt angle of the blades of one of the sets with respect to the blades of the other set, and for simultaneously varying the tilt angle of the blades of both sets from their adjusted positions.

Still another object is to provide a power driven cement finishing machine having two sets of troweling blade assemblies mounted on spaced apart rotating driving shafts which are mounted on a supporting frame and arranged for controlled tilting movements in opposite directions from a normal upright position in order to place the planes of rotation of the sets of blades respectively in positions for generating reactive forces between the blades and the surface of the cement being worked, for propelling the machine in either a forward or reverse working direction.

Further objects of the invention will be brought out in the following part of the specification, wherein detailed description is for the purpose of fully disclosing the invention without placing limitations thereon.

BRIEF DESCRIPTION OF THE DRAWINGS

Referring to the accompanying drawings which are for illustrative purposes only.

DESCRIPTION OF A PREFERRED EMBODIMENT

Figure 1:
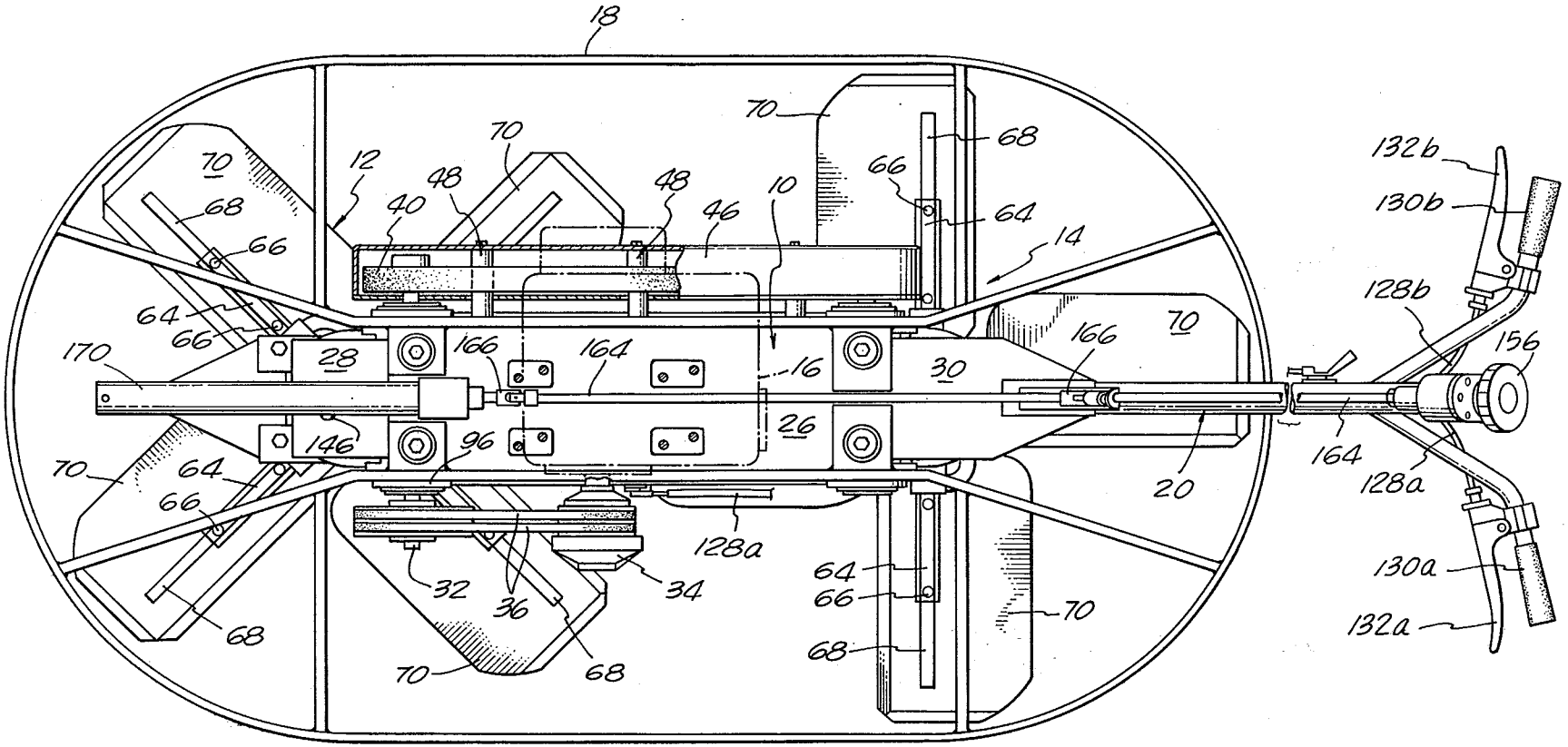
FIG. 1 is a fragmentary top plan view of a cement finishing machine embodying the features of the present invention.

Referring now specifically to the drawings, for illustrative purposes, a cement finishing machine according to the present invention is shown in FIG. 1 as generally comprising an elongate main frame structure 10 which supports two sets of rotary troweling blade assemblies, as generally indicated at 12 and 14, in longitudinally spaced apart relation, the troweling blades being power driven from and internal combustion engine 16 mounted upon the main frame structure. A protective guard rail 18, which is supported from the main frame extends around the sides and ends of the main frame, and the areas of revolution of the troweling blades.

The cement finishing machine of the present invention is unique in that provision is made for tilting the sets of rotary blades in opposite directions in order to generate propelling forces between the troweling blades and the troweled cement surface in a controlled manner such that the machine will be propelled in a generally forward or reverse direction substantially in a path of movement at right angles to the longitudinal axis of the main frame 10. A guiding handle structure, as generally indicated at 20, is positioned at one end of the main frame 10, this handle being manually operable to move the machine in a lateral transverse path to that of the propelled path of movement. The handle 20 is also mounted for pivotal raising and lowering movements which may be utilized for the general and main control of the angular tilt of the blade assemblies 12 and 14, by means of an interconnecting linkage as will hereinafter be explained more fully, and thus selectively determine the propelled direction of the machine. Manually operable controls, as will hereinafter be explained more fully, are also mounted on the handle 20 to provide additional and supplemental remote control of the propelling forces for the machine, and to regulate and adjust the angular tilt of the troweling blades in each of the blade assemblies 12 and 14.

Figure 4:
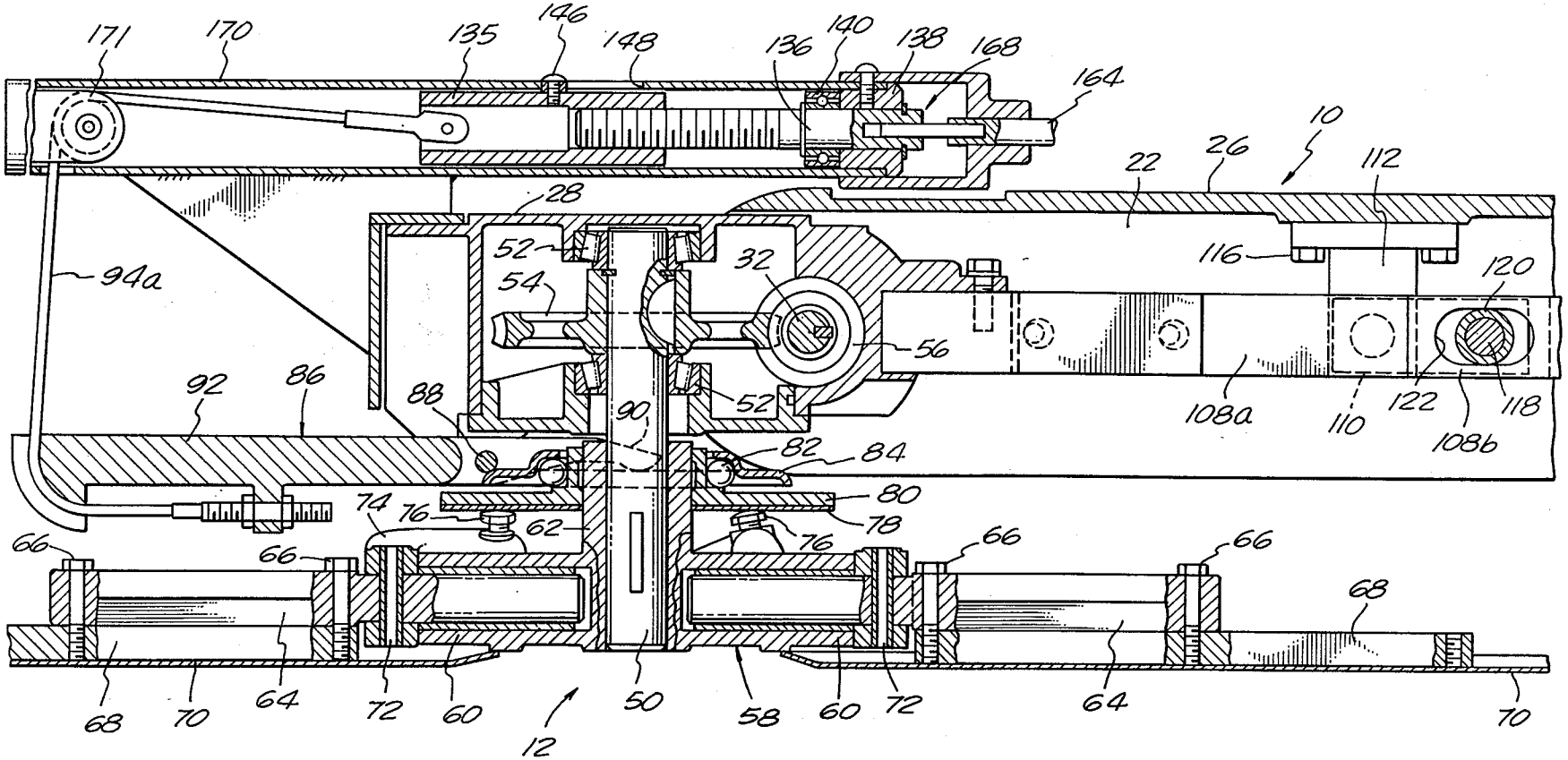
FIG. 4, is an enlarged fragmentary vertical section, taken substantially on line 4—4 of FIG. 3, to show details of the structure for tiltably varying the angle of the troweling blades of each set.

The main frame structure 10 is preferably of box-like construction and is composed of a pair of laterally spaced apart side rail members 22, 24 (FIG. 5) which are spanned and interconnected by a top plate 26 (FIGS. 1 and 4). The blade assemblies 12 and 14 are respectively mounted at the opposite ends of the main frame structure 10 and are supported from gear boxes as generally indicated by the numerals 28 and 30, respectively. As shown in FIG. 1, the gear box 28 has a drive shaft 32 having a driving connection to the internal combustion engine 16, which includes a clutch 34 and driving belts 36. In a similar manner, the gear box 30 has a drive shaft 38. The drive shafts 32 and 38 are driven in synchronized relation by means of a timing belt 40 that is trained over two timing pulleys 42 and 44 on the shafts 32 and 38, respectively. Preferably, the timing belt and associated timing pulleys are protectively enclosed within a suitable cover 46 which may be supported by appropriate brackets 48 extending from the side rail member 22.

Basically, the assembly and operation of each set of troweling blades is similar, and comprises a rotor shaft 50 which has its upper end rotatably supported within the gear box by means of suitable anti-friction bearings 52. This end of the shaft carries a key secured worm gear 54 that is in meshed relation with a worm 56 carried by the drive shaft 32 in the case of the gear box 28, and the drive shaft 38 in the case of the gear box 30. The projecting lower end of the rotor shaft 50 is key connected with a spider structure 58 in which radiating journals 60 extend outwardly from a central cylindrical hub 62. In the structure shown, there are four journals, and each journal is arranged to rotatably support the inner end of a trowel blade shaft 64, the outer end of which is preferably square and is adapted to be secured by bolts 66 to a central 66 to a central rib 68 on the upper surface of a troweling blade 70. The trowel blade shaft 64 is connected intermediate its ends by a pin 72 with a right-angled trowel adjusting lever 74, the outer end of which supports an upwardly extending bolt 76 that is adapted to bear against a wear plate 78 extending over the under surface of a control collar 80 supported centrally upon the cylindrical hub 62 for axially sliding movements thereon.

The control collar 80 is operatively associated with an overlying thrust bearing comprised of anti-friction bearing balls 82 positioned within a slidably mounted annular retaining cap member 84.

The angular tilt of the trowel blades 70 of each blade assembly is controlled through a yoke 86 which is pivoted for swinging movement on a pivot 88, this yoke having a pair or spaced yoke arms 90 on one side of the pivot 88 for engaging diametral surfaces of the cap member 84 on opposite sides of the rotor shaft 50, and a single yoke actuating arm 92 on the opposite side of the pivot 88, which is connected at its outermost end with a trowel tilt adjusting cable **94*a* in the case of blade assembly 12, and adjusting cable 94*b* in the case of the blade assembly 14**.

The operator may readily change the angular position or tilt of the troweling blades of each set by adjusting the pull on the adjusting cables **94*a* and 94*b* by means of control mechanism mounted on the guiding handle, as will subsequently be described in detail. The weight of the machine normally tends to move the troweling blades to a flat position with respect to the cement surface and tension on the cable is employed to tilt the blades by movement of the yoke 86, control collar 80 and the levers 74. The bolts 76 respectively carried by the levers 74** permit individual adjustment of the angular position of each troweling blade of the sets.

Figure 3:
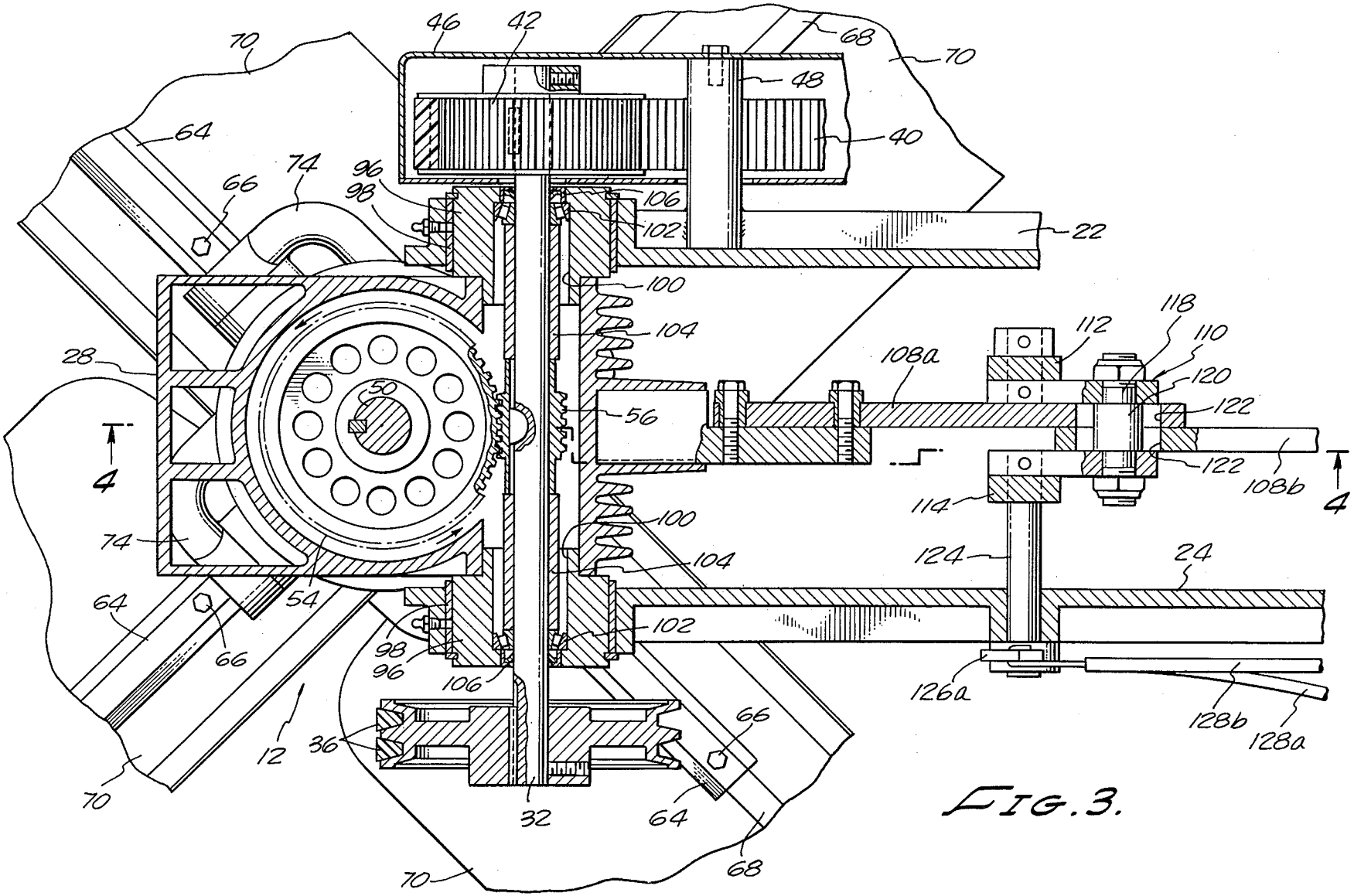
FIG. 3, is an enlarged fragmentary transverse sectional view, taken substantially on line 3—3 of FIG. 2, and showing details of the support and driving connections for one set of troweling blades.
Figures 5, 6:
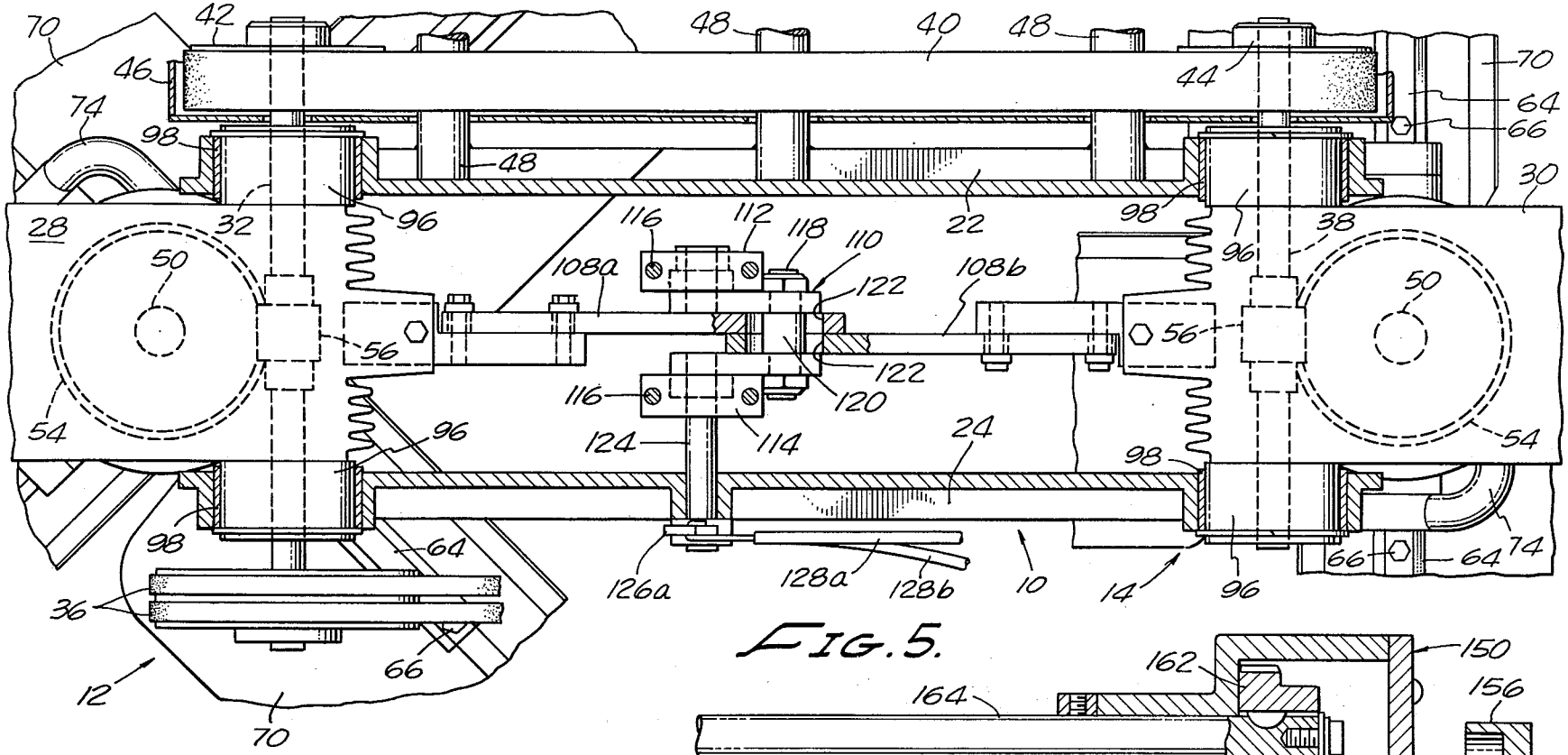
FIG. 5, is an enlarged fragmentary transverse sectional view, taken substantially on line 5—5 of FIG. 2, and showing portions of the control for tilting the blade sets to propelling force generating positions.
FIG. 6 is an enlarged fragmentary vertical sectional view taken through the outer end portion of the guiding handle, and showing portions of the manual control for adjusting and varying the tilt angle of the blades of the troweling sets.

A primary feature of the present invention resides in the provision of a structural arrangement which enables the respective rotor shafts 50 of the troweling blade assemblies 12 and 14 to be tilted in opposite directions from a normal generally upright position to oppositely inclined positions in order to generate propelling forces for moving the machine in either a forward or reverse working direction. This is accomplished by providing a unique pivotal support for each of the troweling blade assemblies. As best shown in FIG. 5, similar pivotal supports are used for the gear boxes 28 and 30, and for purposes of illustration, the description will be confined primarily to gear box 28, as shown in FIG. 3. As will be seen, the gear box is provided with oppositely extending trunnions 96, these trunnions being supported in appropriate bushings 98 mounted on the side rails 22 and 24. The shaft 32 extends through axial bores 100 of the trunnions and at its opposite ends is supported in anti-friction bearings 102 which are retained in position by means of tubular spacers 104 which are interposed between the bearings and the worm 56 carried by the shaft. Preferably, the outer ends of the axial bores 100 are closed by a shaft seal 106. As thus arranged, it will be seen that the axis of the trunnions 96 and the axis of shaft 32 are in coaxial relationship, thus enabling tilting movements of the gear box 28 about the shaft 32, or the gear box 30 about the shaft 38 without interfering with the driving connection between the worm 56 and its associated worm gear 54.

Manually operable control is provided for selectively tilting gear boxes 28 and 30 in appropriate directions to selectively propel the machine in either a forward or reverse direction. For this purpose, the gear boxes 28 and 30 are respectively provided with actuating lever arms 108*a* and 108*b* which are connected with a common crank 110 that is rotatably supported by means of a pair of bracket members 112 and 114 secured to the top plate 26 as by mounting bolts 116. The crank 110 includes a crank pin 118 upon which there is mounted a roller 120 that is positioned within an end slot 122 at the outer end of each of the actuating levers 108*a* and 108*b*.

The main or primary control of the tilt of the gear boxes 28 and 30 is obtained by manual raising and lowering movements of the handle 20. As will be seen, the handle 20 is fixedly secure at its inner end to the gear box 30. Thus, swinging movements of the handle 20 will bodily pivot the gear box 30 about its trunnions 96 and angularly change the position of the axis of rotation of its rotor shaft 50. Tilting movements of gear box 30 will be transmitted to the gear box 28 through the connecting linkage formed by the interconnected lever arms 108*a* and 108*b*, and for each increment of pivotal movement of the gear box 30 by the handle 20, there will be a corresponding but opposite tilting movement of the gear box 28.

Secondary control and fine regulation of the tilt positions of the blade assemblies 12 and 14 is accomplished by means of remote manual control means mounted on and conveniently accessible at the outer end of the guiding handle 20. For this purpose, the crank 110 is connected with a crank shaft 124, which carries oppositely extending radial arms 126*a* and 126*b*, these arms being respectively connected to control pull cables 128*a* and 128*b* which are selectively operable by manual control means from the guiding handle, as will hereinafter be explained more fully, to tilt the troweling blades of the assemblies into positions for generating forward or reverse propelling forces.

More specifically, the gear boxes are so arranged that the blades of the blade assembly 12 will be rotated in a counterclockwise direction, while the blades of the blade assembly 14 will be rotated in a clockwise direction. In the normal or non-tilted position of the blade assemblies, the reactionary forces between the blades and the cement surface being troweled will be substantially cancelled out and no propelling forces will be generated. However, if tension is applied to the control pull cable 128*a* or the handle 20 raised, the planes of rotation of the blades will be tilted so that their adjacent ends will be moving from left to right with respect to the guiding handle, and thus to move the machine towards the left. Similarly, if tension is applied to the pull cable 128*b* or the handle 20 lowered, the planes of rotation of the blades of the assemblies will be tilted in the opposite direction so that the remotely positioned ends of the blades will be moving from right to left with respect to the guiding handle, and thus tend to propel the machine towards the right.

As best shown in FIG. 1, the handle structure 20 is secured at its inner end to the gear box 30, and its other end is fabricated to provide a handlebar with left and right hand grips 130*a* and 130*b* respectively for use in manual guiding of the machine. For convenience, a control grip lever 132*a*, associated with the left hand grip 130*a* is connected with the control pull cable 128*a* for applying tension to this cable and controlling the propelled movement in one direction of the machine. In a similar manner, a control grip lever 132*b*, associated with the right hand grip lever 130*b* is connected to the cable 128*b* for controlling propelled movement of the machine in the opposite direction.

The manual control for adjusting the angle of tilt of the troweling blades of the respective blade assemblies 12 and 14 is also conveniently mounted on the guiding handle structure 20. A feature of this control is that it permits selective independent adjustment of the blades of the respective blade assemblies, as well as simultaneous variation of the blade angles with respect to their adjusted positions. As best shown in FIGS. 1, 2, 4 and 6, tension upon the cable 94*b* is arranged to be directly controlled by means of a threaded screw 134 (FIG. 6) having a shaft portion 136 which is rotatably supported within a bearing bushing 138 and associated a thrust bearing 140 mounted within the outer end portion of a handle forming tubular shaft 142. The threaded screw 134 is in threaded engagement with a sleeve nut 135 which is retained in sliding longitudinal relation to the tubular shaft by a slide screw 146 movable in a slot 148. The sleeve nut 135 is connected with the adjacent end of cable 94*b*.

The outer end of the handle tubular shaft 142 mounts a gear box through which the shaft portion 136 projects. A drive gear 152 formed with a sleeve hub 154 is slidably keyed to the shaft portion 136 and at its outer end mounts a handwheel 156. A compression spring 158, positioned within the gear box, has one end seated within a spring cup 160 which is urged against the side of the drive gear 152 and biases the gear and connected handwheel towards a position in which the drive gear will be in meshed relation with an adjacent driven gear 162 affixed to an end of control shaft 164 for controlling the tension on the control cable 94*a* for adjusting the tilt angle of the troweling blades of the blade assembly 12. It will be seen that the handwheel 156 and connected gear 152 may be axially shifted to a position in which the gear 152 will be moved out of meshed engagement with the gear 162, thus permitting independent adjustment of the troweling blade angle of the blade assembly 14 by means of the cable 94*b*. However, upon release of the handwheel 156, and movement of the gear 152 into meshed relation with the gear 162, the troweling blades of both blade assemblies 12 and 14 may be simultaneously adjusted.

Figure 2:
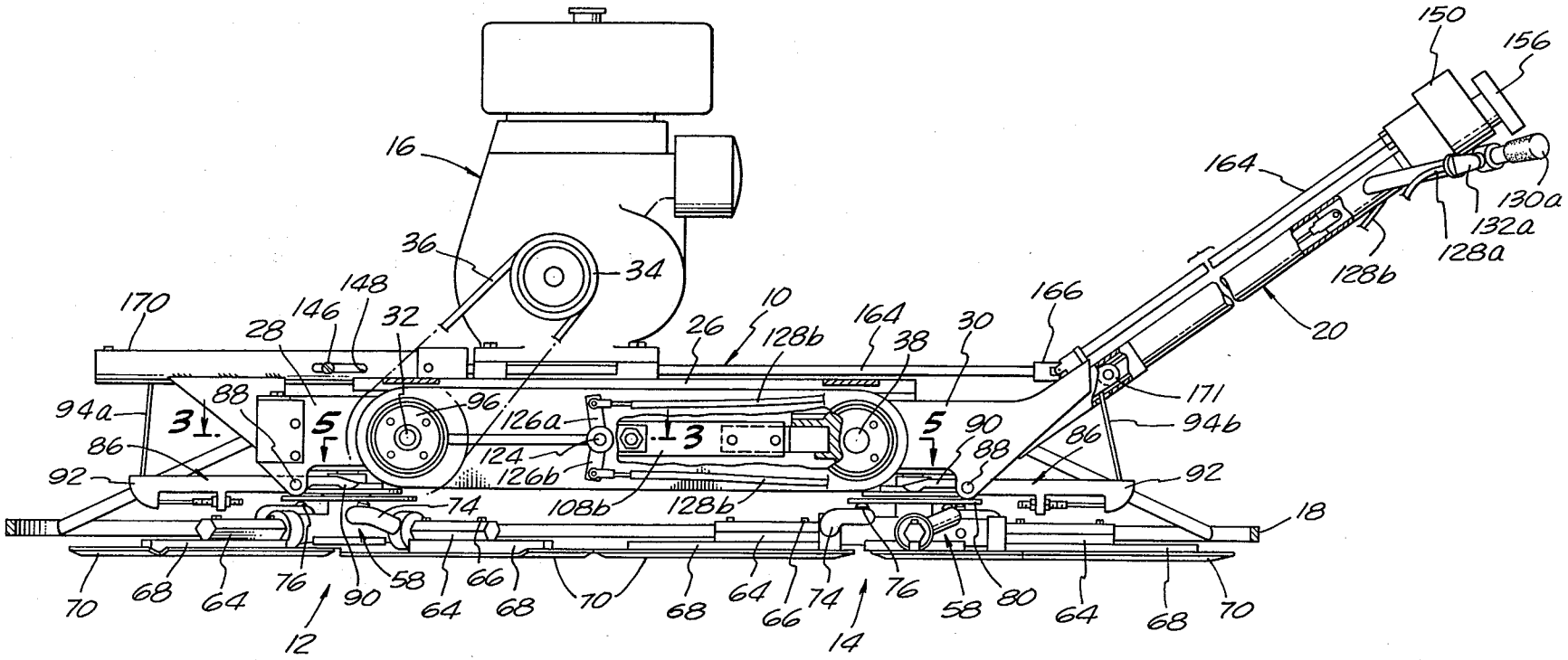
FIG. 2, is a side elevational view.

As shown in FIG. 2, the shaft 164 is articulated by means of universal joint connections 166 in order to allow for relative swinging movement of the gear boxes 28 and 30 with respect to the main frame structure 10. During such movements, there will be a tendency of the inner end of the shaft 164 to move slightly in an axially direction. As shown in FIG. 4, this is permitted by means of a slip-joint coupling, as generally indicated by the numeral 168.

The screw arrangement for controlling the tension of the adjusting cable 94*a* is the same generally as that utilized for the cable 94*b*, and like numerals have been utilized to indicate the similar components. In this instance, the components are mounted within a tubular support 170 which is affixed to the gear box 28 for swinging movement therewith. The adjusting cables 94*a* and 94*b* are similarly trained over a direction changing pulley 171.

From the foregoing description, it is believed that it will be appreciated that the heretofore outlined objects of the invention will be attained, and that the cement finishing machine embodying the described features provides inherent advantages for mechanically troweling cement surfaces.

Various modifications may suggest themselves to those skilled in the art without departing from the spirit of the disclosed invention, and, hence, it is not wished to be restricted to the specific forms or uses mentioned, except to the extent indicated in the appended claims.

I claim:

1. A twin trowel cement finishing machine, comprising: an elongate frame structure;

a pair of sets of troweling blade assemblies supported by rotor shafts depending from the frame structure at spaced apart positions on the longitudinal axis of said frame structure, such that the circular troweling areas of the sets intersect and the blades of the sets are arranged to intermesh as they rotate;

means for rotating said sets of troweling blades in opposite directions; and means for simultaneously tilting the axes of rotation of said shafts in opposite directions from neutral positions in a generally vertical plane containing the longitudinal frame axis, to selectively generate blade reactive forces for propelling the machine in opposite directions along a path of movement extending generally at right angles to the longitudinal axis of said frame structure.

2. A cement finishing machine according to claim 1, in which:

a gear box supports the rotor shaft of each set of troweling blades;

trunnions support each gear box on said frame structure for rocking movements; and a drive shaft having an operative connection with said rotor shaft, is rotatably supported with its axis of rotation coincident with the axis of said trunnions.

3. A cement finishing machine according to claim 2, in which;

the drive shaft has bearing supports in the trunions.

4. A cement finishing machine according to claim 2, in which:

a worm gear is carried by said rotor shaft.

5. A cement finishing machine according to claim 2, in which:

the drive shafts are drivingly interconnected by means including a timing belt; and one of said drive shafts is driven from a power source carried by said frame structure.

6. A cement finishing machine according to claim 1, in which:

a guiding handle is positioned at one end of said frame structure for effecting movement of the machine in directions laterally of its propelled direction.

7. A cement finishing machine according to claim 2, in which:

the means for tilting the axes of rotation of the rotor shafts comprise a guiding handle fixedly secured to one of said gear boxes.

8. A cement finishing machine according to claim 6, in which:

the means for tilting the axes of rotation of the rotor shafts comprises selectively operable manual controls carried by said handle.

9. A cement finishing machine according to claim 2, in which:

said tilting means comprises:

control levers respectively attached to said gear boxes and having their outer ends adjacently disposed;

a rotatable crank connected with the adjacently disposed ends of said arms; and manually operable means for selectively rotating said crank in opposite directions.

10. A cement finishing machine according to claim 9, in which:

a guiding handle is positioned at one end of said frame structure; and said manually operable means comprises right and left hand grip control levers carried by said handle, one of said levers being operable to rotate said crank in one direction, and the other to rotate said crank in an opposite direction.

11. A cement finishing machine according to claim 1, which includes:

means for simultaneously tilting the blades of both of said sets of troweling blades.

12. A cement finishing machine according to claim 11, in which:

a guiding handle is positioned at one end of said frame structure; and said blade tilting means includes manually rotatable means on said handle for independently setting the tilt of one set of said blades to a different troweling angle than the other set of blades.

13. A cement finishing machine according to claim 11, in which:

the means for tilting the blades of said sets comprises:

an adjusting pull cable connection with each of said sets of blades normally biased for movement towards a non-tilted position of said blades; and manually rotatable means for simultaneously applying pulling forces to said cables for adjusting the tilt angle of said blades.

14. A cement finishing machine according to claim 13, in which:

said rotatable means comprises:

relatively rotatable screw and nut means respectively connected with each of said cables; and a single rotatable handwheel operable to actuate both of said screw and nut means.

15. A cement finishing machine according to claim 14, in which:

said handwheel is permanently connected with the screw and nut means connected with one of said cables.

16. A cement finishing machine according to claim 14, in which:

the nut of each of said means is attached to the cable and restrained against rotation, and the screw is rotatably supported and restrained against axial movement.

17. A cement finishing machine according to claim 16, in which:

a toothed pinion is carried by the screw of one of said means;

the rotatable handwheel fixedly mounts a toothed pinion and is axially slidable on the screw of the other of said means, but is restrained against rotation thereon; and spring means normally axially biases said handwheel in a sliding direction to a position in which said pinions are in meshed driving relation and operable by the handwheel to simultaneous adjustably rotate said screws, and upon axial sliding movement of the handwheel to a position in which the pinions are in non-meshed relation, enabling independent adjusting movements of the screw of the other of said means.

18. A cement finishing machine according to claim 14, in which:

a swingably mounted guide handle is positioned at one end of said frame structure;

one of said screw and nut means is mounted on said handle, and the other of said screw and nut means is mounted on said frame structure;

said rotatable handwheel is mounted on said handle; and means including an articulated rotatable shaft interconnects the rotatable handwheel with the nut and screw means mounted on said frame structure.

* * * * *